US011566201B2

(12) United States Patent
Ishida et al.

(10) Patent No.: US 11,566,201 B2
(45) Date of Patent: Jan. 31, 2023

(54) PLUNGER LUBRICANT FOR DIE CASTING AND METHOD OF APPLYING THE SAME

(71) Applicants: TOYOTA JIDOSHA KABUSHIKI KAISHA, Toyota (JP); Nippon Quaker Chemical, Ltd., Yao (JP)

(72) Inventors: Soichiro Ishida, Nagoya (JP); Eiji Tabata, Nisshin (JP); Yuichi Furukawa, Toyota (JP); Katsumi Hongyo, Minoh (JP); Toshikazu Ikeda, Osakasayama (JP)

(73) Assignees: TOYOTA JIDOSHA KABUSHIKI KAISHA, Toyota (JP); Nippon Quaker Chemical, Ltd., Yao (JP)

( * ) Notice: Subject to any disclaimer, the term of this patent is extended or adjusted under 35 U.S.C. 154(b) by 0 days.

(21) Appl. No.: 17/473,355

(22) Filed: Sep. 13, 2021

(65) Prior Publication Data

US 2022/0081640 A1 Mar. 17, 2022

(30) Foreign Application Priority Data

Sep. 16, 2020 (JP) ..... JP2020-155358

(51) Int. Cl.

| | |
|---|---|
| ***C10M 169/04*** | (2006.01) |
| ***B22D 17/20*** | (2006.01) |
| ***C10M 125/26*** | (2006.01) |
| ***C10M 125/24*** | (2006.01) |
| ***C10M 129/40*** | (2006.01) |
| ***C10M 129/44*** | (2006.01) |
| *C10N 40/24* | (2006.01) |
| *C10N 10/02* | (2006.01) |

(52) U.S. Cl.

CPC ..... *C10M 169/04* (2013.01); *B22D 17/2038* (2013.01); *C10M 125/24* (2013.01); *C10M 125/26* (2013.01); *C10M 129/40* (2013.01); *C10M 129/44* (2013.01); *C10M 2201/08* (2013.01); *C10M 2201/085* (2013.01); *C10N 2010/02* (2013.01); *C10N 2040/24* (2013.01)

(58) Field of Classification Search

CPC ..... C10M 169/04; C10M 125/24; C10M 125/26; C10M 129/40; C10M 129/44; C10M 2201/08; C10M 2201/085; B22D 17/2038; C10N 2010/02; C10N 2040/24

USPC ..... 508/144

See application file for complete search history.

(56) References Cited

U.S. PATENT DOCUMENTS

2014/0087981 A1* 3/2014 Okuda ..... C10M 173/00 508/161
2018/0148660 A1* 5/2018 Kozaki ..... C10M 105/26

FOREIGN PATENT DOCUMENTS

CN 102649919 A 8/2012
CN 103534342 A 1/2014
JP 2012-224818 A 11/2012

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A plunger lubricant for die casting includes a component (a), a component (b), a component (c), and water. The component (a) is one or two or more compounds selected from among mineral oils, synthetic hydrocarbons, and fatty acid esters. The component (b) is one or two or more compounds selected from among alkali metal salts of higher fatty acids or alkali metal salts of aliphatic hydroxy acids. The component (c) is an alkali metal salt of an oxoacid or polyoxoacid that is able to be dehydrated and condensed.

8 Claims, 6 Drawing Sheets

FIG. 4

| CONFIGURATION | LOWER LIMIT [%] | UPPER LIMIT [%] | ACTION | EFFECT |
|---|---|---|---|---|
| MINERAL OILS, SYNTHETIC HYDROCARBONS, AND FATTY ACID ESTERS [COMPONENT (a)] | 5 | 25 | REDUCE FRICTION BETWEEN THE TIP AND THE SLEEVE | THE MOLTEN METAL CAN BE INJECTED AT A HIGH SPEED |
| HIGHER FATTY ACID ALKALI METAL SALT AND ALIPHATIC HYDROXY ACID ALKALI METAL SALT [COMPONENT (b)] | 3 | 15 | MAKE AN OIL DISPERSE IN WATER<br>REDUCE FRICTION BETWEEN THE TIP AND THE SLEEVE | THE VISCOSITY OF THE LIQUID IS MADE CLOSE TO THAT OF WATER AND THE WORKABILITY IS IMPROVED<br>THE MOLTEN METAL CAN BE INJECTED AT A HIGH SPEED |
| ALKALI METAL SILICATE [COMPONENT (c)] | 3 | 25 | FORM A NON-COMBUSTIBLE FILM DUE TO HEAT INPUT FROM THE SURROUNDINGS<br>PRODUCE WATER DUE TO HEAT INPUT FROM THE SURROUNDINGS<br>MAKE DELIQUESCENT AFTER DRYING | THE LIQUID SURFACE IS SUFFOCATED, AND COMBUSTION IS INHIBITED<br>THE SYSTEM IS COOLED WITH THE PRODUCED WATER, AND COMBUSTION IS INHIBITED<br>COMBUSTION OF THE RESIDUE IS INHIBITED |
| WATER | 45 | 70 | FORM A LIQUID CONTINUOUS LAYER<br>DISSOLVE SILICATE IN THE CONTINUOUS LAYER AND PRECIPITATE IT ON THE SURFACE OF OIL DROPLETS DURING EVAPORATION<br>FILL THE INSIDE OF THE SLEEVE WITH WATER VAPOR DURING APPLICATION | THE VISCOSITY OF THE LUBRICANT IS LOWERED, AND THE WORKABILITY IS IMPROVED<br>THE NON-COMBUSTIBLE FILM IS CONCENTRATED ON THE SURFACE OF OIL DROPLETS AND THE COMBUSTION INHIBITION EFFICIENCY IS IMPROVED<br>THE OXYGEN CONCENTRATION IN THE SLEEVE IS LOWERED AND COMBUSTION IS RESTRICTED |

| | | SPRAY AIR PRESSURE (MPa) | |
|---|---|---|---|
| | | 0.2 | 0.3 |
| MOLTEN METAL TEMPERATURE (°C) | 650 | NO | NO |
| | 700 | NO | YES |

PLUNGER LUBRICANT FOR DIE CASTING AND METHOD OF APPLYING THE SAME

CROSS-REFERENCE TO RELATED APPLICATION

This application claims priority to Japanese Patent Application No. 2020-155358 filed on Sep. 16, 2020, incorporated herein by reference in its entirety.

BACKGROUND

1. Technical Field

The present disclosure relates to a plunger lubricant for die casting and a method of applying the same.

2. Description of Related Art

In die casting of a metal material such as aluminum, a molten metal is injected into a die cast mold when a plunger slides a sleeve. Then, in order to reduce wear of the sleeve on the sliding surface between the plunger and the sleeve and stabilize an injection speed of the plunger, a lubricant is supplied between the plunger and the sleeve (in particular, an inner wall of the sleeve). Here, when a molten metal is poured into the sleeve after an oil-based lubricant is supplied into the sleeve, there is a possibility of the oil-based lubricant being exposed to a high temperature and an oil component being combusted.

Japanese Unexamined Patent Application Publication No. 2012-224818 (JP 2012-224818 A) discloses a water-soluble plunger lubricant for die casting that inhibits combustion. The lubricant according to JP 2012-224818 A includes a component (a) which is one or two or more compounds selected from among mineral oils, synthetic hydrocarbons, oils and fats, and fatty acid esters, a component (b) which is one or two or more compounds selected from among alkali metal salts of higher fatty acids or alkali metal salts of aliphatic hydroxy acids, a component (c) which is one or two or more compounds selected from among alkali metal salts of synthetic sulfonic acids or alkali metal salts of petroleum sulfonic acids, fine particle silica, and water.

SUMMARY

The lubricant according to JP 2012-224818 A contains water, and higher fatty acid alkali metal salts, and thus inhibits combustion. However, the lubricant according to JP 2012-224818 A still has room for improvement in combustion inhibition ability. For example, when water evaporates, the effect of the lubricant according to JP 2012-224818 A becomes weaker. In other words, the lubricant according to JP 2012-224818 A has a possibility of difficulty in inhibiting combustion when water evaporates. Therefore, the lubricant according to JP 2012-224818 A may not be able to appropriately inhibit combustion.

The present disclosure provides a plunger lubricant for die casting that can appropriately inhibit combustion and a method of applying the same.

A first aspect of the present disclosure is a plunger lubricant for die casting, including: a component (a) which is one or two or more compounds selected from among mineral oils, synthetic hydrocarbons, and fatty acid esters; a component (b) which is one or two or more compounds selected from among alkali metal salts of higher fatty acids or alkali metal salts of aliphatic hydroxy acids; a component (c) which is an alkali metal salt of an oxoacid or polyoxoacid that is able to be dehydrated and condensed; and water.

According to the above configuration, the present disclosure can inhibit combustion of the plunger lubricant by the action of the alkali metal salt of an oxoacid or polyoxoacid that is able to be dehydrated and condensed.

In addition, the component (c) may be an alkali metal salt of silicic acid. An amount of the component (a) added with respect to a total amount of the plunger lubricant may be 5 to 25%, an amount of the component (b) added with respect to the total amount of the plunger lubricant may be 3 to 15%, and an amount of the alkali metal salt of silicic acid with respect to the total amount of the plunger lubricant may be 3 to 25%.

Thereby, it is possible to appropriately add the component (a) in an amount required for flame retardancy of the plunger lubricant and lubrication.

In addition, the component (c) may be an alkali metal salt of boric acid. An amount of the component (a) added with respect to a total amount of the plunger lubricant may be 5 to 25%, an amount of the component (b) added with respect to the total amount of the plunger lubricant may be 3 to 15%, and an amount of the alkali metal salt of boric acid with respect to the total amount of the plunger lubricant may be 0.5 to 30%.

Thereby, it is possible to appropriately add the component (a) in an amount required for flame retardancy of the plunger lubricant and lubrication.

In addition, the component (c) may be an alkali metal salt of phosphoric acid. An amount of the component (a) added with respect to a total amount of the plunger lubricant may be 5 to 25%, an amount of the component (b) with respect to the total amount of the plunger lubricant may be 3 to 15%, and an amount of the alkali metal salt of phosphoric acid with respect to the total amount of the plunger lubricant may be 0.5 to 30%.

Thereby, it is possible to appropriately add the component (a) in an amount required for flame retardancy of the plunger lubricant and lubrication.

In addition, a second aspect of the present disclosure is a method of applying a plunger lubricant for die casting including applying the plunger lubricant for die casting according to the first aspect by spraying it onto an inner surface of a sleeve on which a plunger that injects a molten metal into a mold in a die casting device slides.

Thereby, it is possible to further inhibit combustion of the plunger lubricant applied to the sleeve.

According to the present disclosure, it is possible to provide a plunger lubricant for die casting that can appropriately inhibit combustion and a method of applying the same.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein:

FIG. 4 is a diagram illustrating components of a plunger lubricant for die casting according to the present embodiment;

DETAILED DESCRIPTION OF EMBODIMENTS

Hereinafter, embodiments of the present disclosure will be described with reference to the drawings. However, the present disclosure is not limited to the following embodiments. In addition, in order to clarify the explanation, the following description and drawings have been appropriately simplified.

(Die Casting Device)

Figure 1:
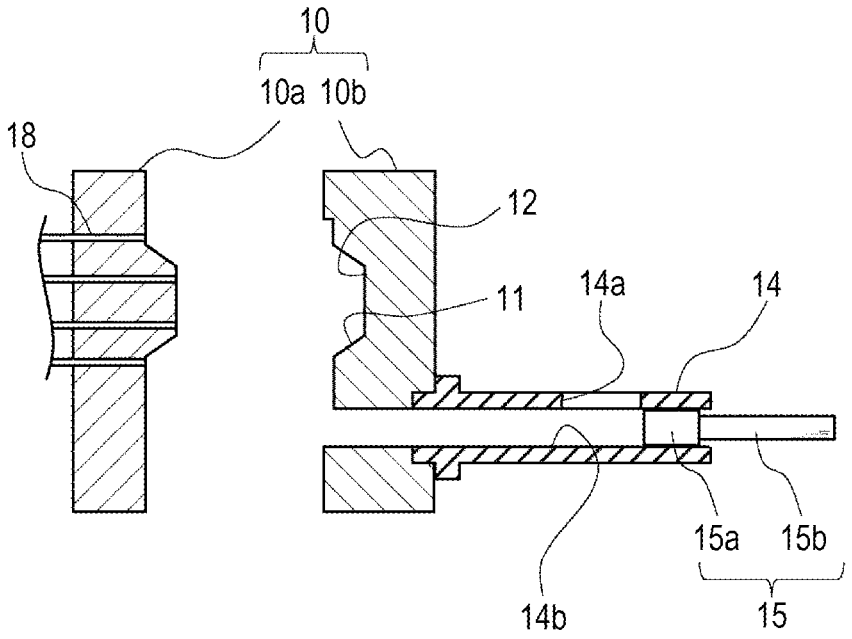
FIG. 1 is a diagram showing a die casting device 1 according to the present embodiment.
Figure 2:
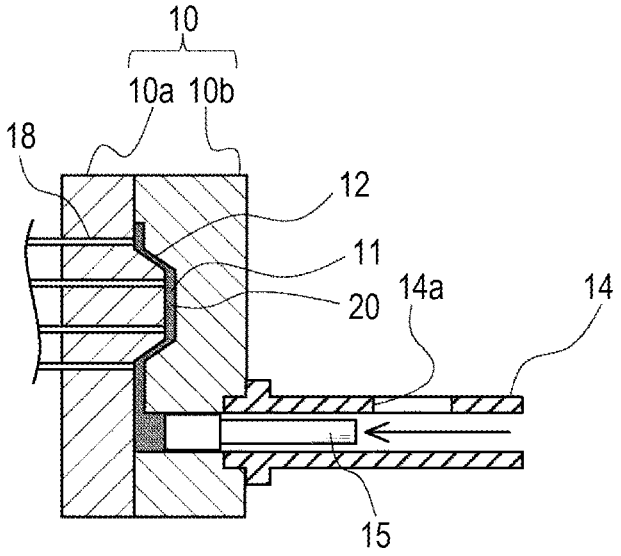
FIG. 2 is a diagram showing the die casting device 1 according to the present embodiment.
Figure 3:
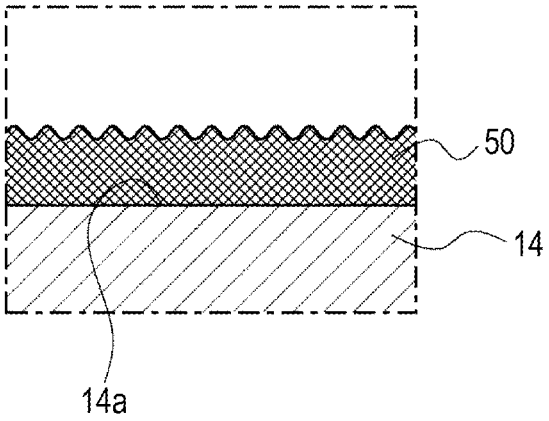
FIG. 3 is a diagram showing the die casting device 1 according to the present embodiment.

FIG. 1 to FIG. 3 are diagrams showing a die casting device 1 according to the present embodiment. The die casting device 1 includes a mold 10, a sleeve 14, and a plunger 15. The mold 10 is used for forming a casting by pressure-solidifying a molten metal. The mold 10 is, for example, the mold 10 used in a die casting method. The mold 10 used in the die casting method is composed of, for example, a plurality of components, so that the casting that has been cast can be taken out. The mold 10 includes, for example, a moving type mold 10*a* and a fixed side mold 10*b*. The mold 10 is composed of a predetermined steel material. For example, the mold 10 contains alloy tool steel for a hot mold (SKD61 base material). The SKD61 base material is a kind of alloy tool steel in which tungsten, molybdenum, chrome, vanadium, or the like is added to carbon tool steel. Here, the mold 10 is not limited to a mold including the moving type mold 10*a* and the fixed side mold 10*b*. In addition, the material of the mold 10 is not limited to the SKD61 base material.

The mold 10 includes a cavity 11. The cavity 11 is a cavity part formed inside the mold 10 and is a part filled with a molten metal 20. The cavity 11 is formed inside the mold 10, for example, when the moving type mold 10*a* and the fixed side mold 10*b* are mold-clamped. A surface of the mold 10 in contact with the cavity 11 is referred to as a cavity surface 12. The cavity 11 is surrounded by the cavity surface 12 of the mold 10. Therefore, the cavity 11 surrounded by the cavity surface 12 of the mold 10 is filled with the molten metal 20.

The sleeve 14 is connected to the mold 10. The sleeve 14 is cylindrical. One end of the sleeve 14 is connected to an opening communicating with the cavity 11 of the mold 10. The plunger 15 is inserted into the other end of the sleeve 14. A molten metal supply port 14*a* is provided at a part of the sleeve 14. A pin 18 is used for taking out the casting.

The plunger 15 slides the sleeve 14 and injects the molten metal 20 into the inside (the cavity 11) of the mold 10. The plunger 15 includes a plunger tip 15*a* and a plunger rod 15*b*. The plunger tip 15*a* is a cylindrical member in direct contact with the molten metal 20 in the sleeve 14. The plunger tip 15*a* is connected to a plunger drive source (not shown) that drives the plunger 15 via the plunger rod 15*b* which is a rod-like member. When the plunger drive source is driven, the plunger tip 15*a* slides an inner surface 14*b* of the sleeve 14 and pushes the molten metal 20 into the cavity 11.

As shown in FIG. 2, the molten metal 20 is supplied from the supply port 14*a* into the cylindrical sleeve 14 and pushed into the cavity 11 by the plunger 15. The molten metal 20 passes through the sleeve 14 and is sent into the cavity 11.

FIG. 3 is an enlarged view of the inner surface 14*b* of the sleeve 14. As shown in FIG. 3, a lubricant 50 which is a plunger lubricant for die casting is applied to the inner surface 14*b* of the sleeve 14. The lubricant 50 is used to reduce friction between the plunger 15 (the plunger tip 15*a*) and the sleeve 14 (the inner surface 14*b*). The details will be described below.

(Plunger Lubricant for Die Casting)

The plunger lubricant for die casting (the lubricant 50) includes a component (a) that mainly functions as a lubricating component, a component (b) that mainly functions as a surfactant, a component (c) which is an alkali metal salt of an oxoacid or polyoxoacid that is able to be dehydrated and condensed, and water. As will be described below, the component (a) is one or two or more compounds selected from among mineral oils, synthetic hydrocarbons, and fatty acid esters. As will be described below, the component (b) is one or two or more compounds selected from among alkali metal salts of higher fatty acids or alkali metal salts of aliphatic hydroxy acids. As will be described below, an alkali metal salt of an oxoacid or polyoxoacid that is able to be dehydrated and condensed (hereinafter simply referred to as "alkali metal salt of oxoacid" or "oxoacid salt") may be, for example, an alkali metal salt of a divalent or higher oxoacid. In addition, the alkali metal salt of an oxoacid may be, for example, an alkali metal salt of silicic acid, an alkali metal salt of boric acid, or an alkali metal salt of phosphoric acid. Examples of alkali metals constituting an alkali metal salt of an oxoacid include sodium, lithium, and potassium, and sodium and potassium are preferable.

As in the present embodiment, when the alkali metal salt (the component (c)) of the oxoacid described above is added to the lubricant 50, it is possible to inhibit combustion of the lubricant 50. That is, as will be described below, it is possible to inhibit combustion of the lubricant 50 by the action of the alkali metal salt of an oxoacid. For example, an alkali metal salt of an oxoacid undergoes a dehydration condensation reaction due to heat input from a heat source (the molten metal 20, etc), an inorganic oligomer film or an inorganic polymer film (non-combustible film) and water are produced, and combustion of the lubricant 50 can be inhibited due to a suffocation effect of the inorganic oligomer film or inorganic polymer film and a cooling effect of water. In addition, as will be described below, even after water contained in the lubricant 50 has evaporated, combustion of the lubricant 50 can be inhibited due to a deliquescent reaction of the alkali metal salt of an oxoacid.

FIG. 4 is a diagram illustrating components of the plunger lubricant for die casting (the lubricant 50) according to the present embodiment. In the example in FIG. 4, the component (c) is an alkali metal silicate, that is, the lubricant 50 contains the component (a), the component (b), the alkali metal silicate (the component (c)), and water.

As described above, the component (a) is one or two or more compounds selected from among mineral oils, synthetic hydrocarbons, and fatty acid esters. The action of the component (a) is to reduce friction between the plunger 15 (the plunger tip 15*a*) and the sleeve 14. Thereby, the component (a) can inject the molten metal 20 at a high speed.

In addition, the amount of the component (a) added with respect to the total amount of the lubricant 50 is preferably 5 to 25% (weight %). It has been clarified in an experiment that, when the amount of the component (a) added exceeds an upper limit of 25%, it is difficult to make the lubricant 50 a uniform product that does not cause separation. In addition, it has been clarified in an experiment that, when the amount of the component (a) added is less than a lower limit of 5%, it is difficult to obtain sufficient lubricity.

Here, examples of mineral oils constituting the component (a) include machine oils, turbine oils, spindle oils, and process oils. Examples of synthetic hydrocarbons constituting the component (a) include polyalphaolefin. Examples of fatty acid esters constituting the component (a) include fatty acids such as lauric acid, myristic acid, palmitic acid, palmitoleic acid, stearic acid, oleic acid, vaccenic acid, linoleic acid, linolenic acid, and arachidic acid, and esters produced by reacting a monovalent or multivalent alcohol. Examples of monovalent or multivalent alcohols include monovalent alcohols having 1 to 18 carbon atoms such as 2-ethylhexanol, isodecanol, and tridecanol, and trimethylolpropane, pentaerythritol, neopentyl glycol, and dipentaerythritol.

As described above, the component (b) is one or two or more compounds selected from among alkali metal salts of higher fatty acids or alkali metal salts of aliphatic hydroxy acids. Here, the types of higher fatty acids, aliphatic hydroxy acids, and alkali metals are not particularly limited as long as they are soluble as lubricant components in water. The component (b) has an action of dispersing the component (a) (oil) in water. Thereby, the viscosity of the liquid (the lubricant 50) is made close to the viscosity of water and the workability can be improved. In addition, the component (b) has an action of reducing friction between the plunger 15 (the plunger tip 15*a*) and the sleeve 14. Thereby, the molten metal 20 can be injected at a high speed.

In addition, the amount of the component (b) added with respect to the total amount of the lubricant 50 is preferably 3 to 15% (weight %). It has been clarified in an experiment that, when the amount of the component (b) added exceeds an upper limit of 15%, it is difficult to dissolve the component (b) in water. In addition, it has been clarified in an experiment that, when the amount of the component (b) added is less than a lower limit of 3%, the surfactant action is lowered and it is difficult to dissolve the component (a).

The alkali metal silicate has an action of causing a dehydration condensation reaction due to heat input from surrounding heat sources (the molten metal 20, the sleeve 14, etc.) to form a non-combustible film (silicate film) on the surface of the lubricant 50. Thereby, the liquid surface of the lubricant 50 is suffocated (oxygen deficiency), and combustion of the lubricant 50 can be inhibited. In addition, the alkali metal silicate has an action of causing a dehydration condensation reaction due to heat input from surrounding heat sources (the molten metal 20, the sleeve 14, etc.) to produce water. Thereby, the system (the sleeve 14, the plunger 15, etc.) is cooled with the produced water, and combustion can be inhibited. Here, similarly, alkali metal salts of other oxoacids have such actions and effects.

In addition, the alkali metal silicate has an action of being dissolved due to a deliquescent reaction after drying. The deliquescent reaction is a phenomenon in which fine crystals capture water vapor in the atmosphere and dissolve. Thereby, even if water evaporates, because the lubricant 50 can contain a large amount of water due to the deliquescent reaction, combustion due to spillage of the lubricant 50 that has become a residue due to evaporation of water can be inhibited. Therefore, the lubricant 50 containing the alkali metal silicate can inhibit combustion even if water evaporates. In other words, the lubricant 50 containing the alkali metal silicate can improve the combustion inhibition ability. Here, similarly, alkali metal salts of other oxoacids have such actions and effects.

Here, the dehydration condensation reaction of the alkali metal silicate is shown below.

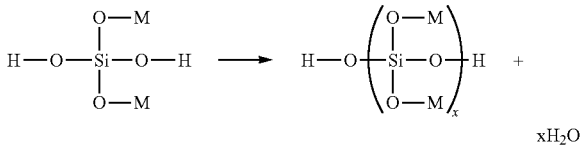

In addition, the deliquescent reaction of the alkali metal silicate is shown below.

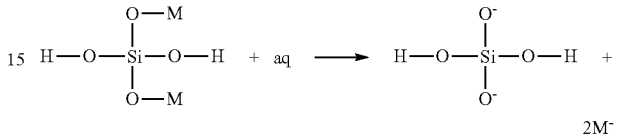

In addition, the amount of the alkali metal silicate added with respect to the total amount of the lubricant is preferably 3 to 25%. It has been clarified in an experiment that, when the amount of the alkali metal silicate added exceeds an upper limit of 25%, since water and the component (a) are separated, it is difficult to appropriately add the component (a) in an amount required for lubrication. In addition, it has been clarified in an experiment that, when the amount of the alkali metal silicate added exceeds an upper limit of 20%, it is difficult to obtain sufficient lubricity. In addition, it has been clarified in an experiment that, when the amount of the alkali metal silicate added is less than a lower limit of 3%, it is difficult to obtain a sufficient combustion inhibition ability (flame retardancy). Thus, when the amount of the alkali metal silicate added is set to be within the above range, it is possible to appropriately add the component (a) in an amount required for flame retardancy and lubrication of the lubricant 50.

Within the lubricant 50, the balance after the component (a), the component (b) and the component (c) described above is water. The amount of water added is represented by a portion obtained by excluding a solid content concentration in the lubricant from the total amount of the lubricant. For example, the amount of water added with respect to the total amount of the lubricant is preferably 45 to 70%.

Water has an action of forming a liquid continuous layer. Thereby, the viscosity of the lubricant 50 can be lowered and the workability can be improved. In addition, water has an action of dissolving silicate (alkali metal silicate) in a continuous layer and precipitating silicate on the surface of oil droplets during evaporation. Thereby, the non-combustible film can be concentrated on the surface of oil droplets and the combustion inhibition efficiency can be improved. In addition, water has an action of filling the inside of the sleeve 14 with water vapor when the lubricant 50 is applied to the sleeve 14. Thereby, the oxygen concentration in the sleeve 14 can be lowered and combustion can be inhibited.

Here, as described above, the alkali metal salt of an oxoacid (the component (c)) may be an alkali metal borate or an alkali metal phosphate. Even in the case of the alkali metal borate or alkali metal phosphate, the ranges of the amounts of the component (a) and the component (b) added are the same as that shown in FIG. 4 described above.

The amount of the alkali metal borate added with respect to the total amount of the lubricant is preferably 0.5 to 30%. It has been clarified in an experiment that, when the amount of the alkali metal silicate added exceeds an upper limit of 30%, it is difficult to dissolve of the component (a) in an amount required for lubrication. In addition, it has been clarified in an experiment that, when the amount of the alkali metal borate added is less than a lower limit of 0.5%, it is difficult to obtain a sufficient combustion inhibition ability (flame retardancy). Thus, when the amount of the alkali metal borate added is set to be within the above range, it is possible to appropriately add the component (a) in an amount required for flame retardancy of the lubricant 50 and lubrication.

In addition, the amount of the alkali metal phosphate added with respect to the total amount of the lubricant is preferably 0.5 to 30%. It has been clarified in an experiment that, when the amount of the alkali metal silicate added exceeds an upper limit of 30%, it is difficult to dissolve the component (a) in an amount required for lubrication. In addition, it has been clarified in an experiment that, when the amount of the alkali metal phosphate added is less than a lower limit of 0.5%, it is difficult to obtain a sufficient combustion inhibition ability (flame retardancy). Thus, when the amount of the alkali metal phosphate added is set to be within the above range, it is possible to appropriately add the component (a) in an amount required for flame retardancy of the lubricant 50 and lubrication.

Here, the lubricant 50 with the amounts of the above components added can be used as an undiluted solution. In addition, in consideration of costs and transportation methods, a substance containing a large amount of a solid content is prepared in advance within a range in which the stability of the lubricant is not impaired, and may be used by being diluted to within the above range before use. Alternatively, the lubricant 50 in the above range can be used by being diluted with water.

Here, regarding the particle size of the oil (the component (a)) in water, in order to prevent separation of water and the oil and improve the combustion inhibition ability of the residue when water evaporates, it is necessary to set the particle size of the oil to be 100 nanometers or less. This can be achieved by adjusting the amounts of water, the oil (the component (a)) and the surfactant (the component (b)) and general stirring, and no special stirring method is required. Here, in this state, unlike a general emulsion, the liquid (the lubricant 50) becomes transparent without turbidity.

1. Here, in order to adjust the pH of the lubricant 50, fatty acids, aliphatic dibasic acids, and hydroxy fatty acids can be used.

2. Here, in order to adjust the oil particle size of the lubricant 50, a nonionic surfactant and a water-soluble amine can be used.

(Experimental Details)

The inventors have verified whether the lubricant containing the above alkali metal silicate (hereinafter referred to as "silicate") could be used for an actual machine (the plunger 15 and the sleeve 14 of the die casting device 1). First, regarding the method of applying the lubricant to the sleeve 14, a dropwise addition method and a spray method were compared. As a result, regarding lubrication performance, the lubricity was better in the spray method because the lubricant could be applied to the entire sleeve 14. On the other hand, although the lubricant was not combusted in the dropwise addition method, when the lubricant was supplied to an actual machine by the spray method, it ignited during pouring. Therefore, the following Experiments 1 to 3 were performed.

<Experiment 1>

The relationship between application conditions and the height of a pillar of fire generated during pouring was examined. After the lubricant was applied to the sleeve 14 of the actual machine under various conditions, and the height of the pillar of fire generated when the molten metal 20 was poured was measured using a video. The lubricant was applied directly under the supply port 14*a* of the sleeve 14 under a total of three sets of conditions including two conditions with spraying and one condition with dropwise addition. An air pressure during application by spraying was 0.2 MPa and 0.3 MPa (two conditions), a hydraulic pressure during application by dropwise addition was 0.15 MPa (one condition), and the amount of the lubricant applied was 6 g. The molten metal 20 to be poured was 12 kg of molten aluminum at 660° C.

<Experiment 2>

The effects of spray conditions and the lubricant composition on the ignitability during hot water supply were examined. After a lubricant in which the amount of silicate added (silicate amount) was changed was applied by spraying to a block simulating the sleeve 14 of the actual machine, it was poured into the block, and it was checked whether there was ignition. The amount of silicate was set to 1 time, 1.5 times, and 2 times (three conditions) the amount of silicate of the lubricant used in Experiment 1. The air pressure during spraying was set to 0.2 MPa and 0.3 MPa (two conditions), the hydraulic pressure during dropwise addition was 0.15 MPa (one condition), and the amount of the lubricant applies was 0.7 g. Regarding the molten metal 20 to be poured, 100 g of molten aluminum was poured at 650° C. and 700° C. (two conditions).

<Experiment 3>

The hygroscopicity and ignitability when the lubricant was left were examined. After the lubricant was dried in a constant temperature chamber, at (0 h) immediately after the lubricant was taken out from the constant temperature chamber and 1 h, 3 h, 9 h after it was left in the external environment, the weight of the lubricant was measured and pouring for the lubricant was performed, and it was checked whether there was a change in the weight at that time and whether there was ignition. The amount of the lubricant used was 6 g as the weight before drying, and the lubricant was dried for 16 h in the constant temperature chamber at 150° C. The external environment was in a factory with favorable ventilation with a temperature of 38° C. and a humidity of 40%.

(Experiment Results)

<Experiment 1>

Figures 5, 6:
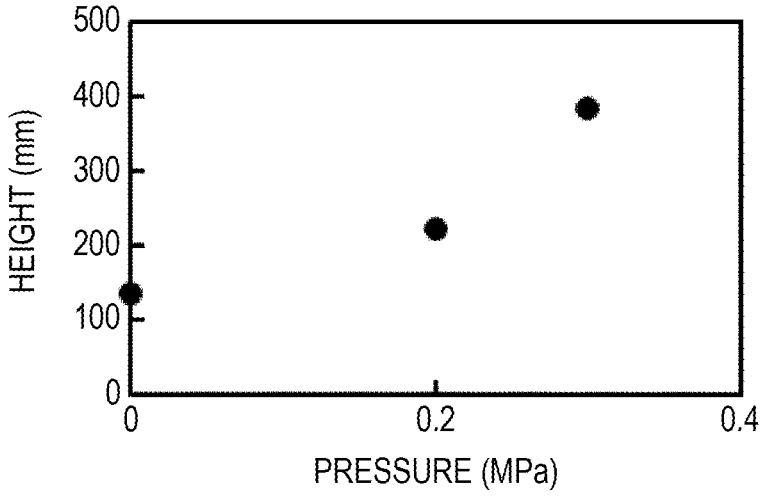
FIG. 5 is a diagram showing experiment results related to Experiment 1.
FIG. 6 is a diagram showing experiment results related to Experiment 2.

FIG. 5 is a diagram showing experiment results related to Experiment 1. FIG. 5 is a graph showing the relationship between the air pressure and the height of the pillar of fire. Here, the condition for applying by dropwise addition was, for convenience, applying at an air pressure of 0 MPa. As shown in FIG. 5, in the results, when the air pressure was higher and the mist diameter was smaller, the pillar of fire was higher. Thus, it was found that combustibility of the lubricant was also affected by application conditions. That is, as a method of applying the lubricant, by applying the lubricant 50 to the inner surface of the sleeve 14 by spraying, it was possible to further inhibit combustion of the lubricant applied to the sleeve 14.

Here, the following two reasons were conceivable as the reason why combustion became intense due to miniaturization of droplets.

The first reason was that a specific surface area of droplets increased due to the miniaturization, and the oxidation reaction was promoted. The specific surface area (area/volume) of the droplets was inversely proportional to the representative diameter of the droplets. Therefore, it is thought that, when the droplets were miniaturized, the heat input and oxygen supply through the surface of the droplets become intense, and the oxidation reaction of each droplet becomes intense.

The second reason was that, since a total surface area of the droplets increased, the coverage of the silicate film decreased and combustion could not be inhibited. For a certain amount of the liquid (lubricant), a total surface area of the droplets was inversely proportional to the representative diameter of the droplets. It is thought that, since the amount of silicate contained in the applied lubricant was limited, if the droplets were miniaturized, the silicate film could not sufficiently cover the droplets, and combustion inhibition was insufficient.

<Experiment 2>

FIG. 6 is a diagram showing experiment results related to Experiment 2. Here, the lubricant having a 1-fold amount of silicate ignited under any conditions, and the lubricant having a 2-fold amount of silicate did not ignite under any conditions. FIG. 6 shows the presence or absence of ignition under the conditions in the case of the lubricant having a 1.5-fold amount of silicate.

In the case of the lubricant having a 1.5-fold amount of silicate, ignition was performed only when the air pressure was 0.3 MPa and the molten metal temperature was 700° C., which were the conditions of easiest ignition. Based on these results, it was confirmed that, when the amount of silicate in the lubricant increased, the lubricant was unlikely to ignite. On the other hand, it is thought that, it would be more preferable to evaluate flame retardant performance of the lubricant when the lubricant is actually used, not only regarding an ability of the liquid alone due to the components of the lubricant but also including the usage environment.

<Experiment 3>

Figure 7:
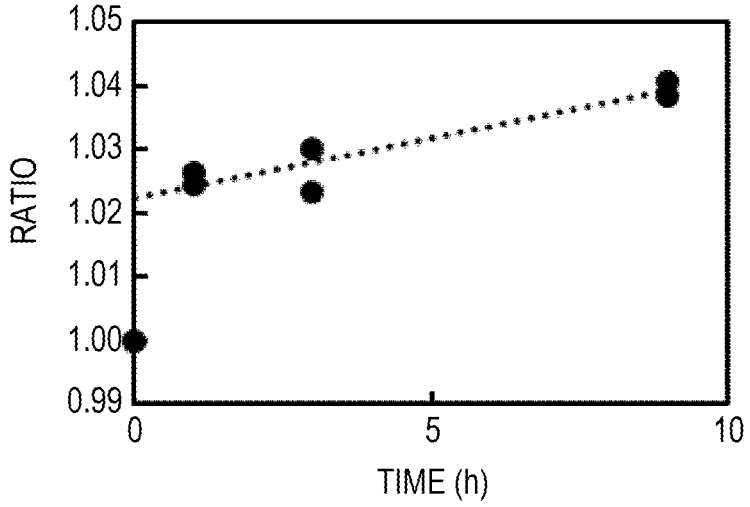
FIG. 7 is a diagram showing experiment results related to Experiment 3.

FIG. 7 is a diagram showing experiment results related to Experiment 3. Here, it is thought that the weight reduced by drying was almost the same as the amount of water contained in the lubricant, and water in the lubricant could be sufficiently removed. FIG. 7 is a graph showing the relationship between the time after the lubricant dried in the constant temperature chamber was taken out from the constant temperature chamber and the ratio of the weight at that time to the weight immediately after drying was completed.

In FIG. 7, it was observed that the weight of the lubricant linearly changed after 1 h to after 9 h. However, the weight immediately after drying was completed and the intercept of this approximate straight line were significantly different. Therefore, it is thought that, after immediately after drying was completed, two types of reactions with different moisture absorption rates and moisture absorption limits occurred and it was estimated that the hygroscopic action of a silanol group operated in addition to the deliquescent reaction.

The hygroscopic reaction of the silanol group of the alkali metal silicate is shown below.

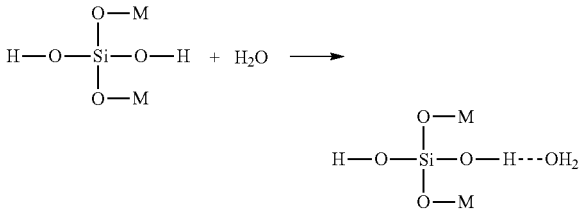

Here, immediately after drying was completed, ignition by the molten metal was observed but no ignition was confirmed when moisture was absorbed for 1 h or longer. That is, it is thought that, even if the lubricant scattered out of the sleeve, water in the atmosphere quickly made combustion difficult within 1 h. Thus, it was found that adding silicate (oxoacid salt) to the lubricant made the lubricant deliquescent, which was effective in improving flame retardancy.

Modification Examples

Here, the present disclosure is not limited to the above embodiment, and can be appropriately modified without departing from the spirit. For example, in the above embodiment, the alkali metal salt of an oxoacid is an alkali metal salt of silicic acid, an alkali metal salt of boric acid or an alkali metal salt of phosphoric acid, but other oxoacid salts may be used.

What is claimed is:

1. A plunger lubricant for die casting, consisting of:

a component (a) which is one or two or more compounds selected from among mineral oils, synthetic hydrocarbons, and fatty acid esters;

a component (b) which is one or two or more compounds selected from among alkali metal salts of fatty acids having 13 carbons or more or alkali metal salts of aliphatic hydroxy acids;

a component (c) which is an alkali metal salt of an oxoacid or polyoxoacid that is able to be dehydrated and condensed; and water.

2. The plunger lubricant for die casting according to claim 1, wherein the component (c) is an alkali metal salt of silicic acid.

3. The plunger lubricant for die casting according to claim 2, wherein an amount of the component (a) added with respect to a total amount of the plunger lubricant is 5 to 25%, wherein an amount of the component (b) added with respect to the total amount of the plunger lubricant is 3 to 15%, and wherein an amount of the alkali metal salt of silicic acid add with respect to the total amount of the plunger lubricant is 3 to 25%.

4. The plunger lubricant for die casting according to claim 1, wherein the component (c) is an alkali metal salt of boric acid.

5. The plunger lubricant for die casting according to claim 4, wherein an amount of the component (a) added with respect to a total amount of the plunger lubricant is 5 to 25%, wherein an amount of the component (b) added with respect to the total amount of the plunger lubricant is 3 to 15%, and wherein an amount of the alkali metal salt of boric acid with respect to the total amount of the plunger lubricant is 0.5 to 30%.

6. The plunger lubricant for die casting according to claim 1, wherein the component (c) is an alkali metal salt of phosphoric acid.

7. The plunger lubricant for die casting according to claim 6, wherein an amount of the component (a) added with respect to a total amount of the plunger lubricant is 5 to 25%, wherein an amount of the component (b) with respect to the total amount of the plunger lubricant is 3 to 15%, and wherein an amount of the alkali metal salt of phosphoric acid with respect to the total amount of the plunger lubricant is 0.5 to 30%.

8. A method of applying a plunger lubricant for die casting, comprising applying the plunger lubricant for die casting according to claim 1 by spraying it onto an inner surface of a sleeve on which a plunger that injects a molten metal into a mold in a die casting device slides.

* * * * *